United States Patent [19]

Empie

[11] Patent Number: 4,513,972

[45] Date of Patent: Apr. 30, 1985

[54] GOLFER'S HEAD MOVEMENT RESTRAINING DEVICE

[76] Inventor: John E. Empie, 5428 Halifax La., Minneapolis, Minn. 55424

[21] Appl. No.: 490,431

[22] Filed: May 2, 1983

[51] Int. Cl.[3] ..... A63B 69/36

[52] U.S. Cl. ..... 273/190 R

[58] Field of Search ..... 273/190 R, 191 R, 190 A, 273/190 B, 183 B

[56] References Cited

U.S. PATENT DOCUMENTS

| | | | |
|---|---|---|---|
| 1,238,492 | 8/1917 | Byrne | 273/190 R |
| 1,936,143 | 11/1933 | Shea | 273/190 R |
| 1,962,256 | 6/1934 | Nelson et al. | 273/190 R |
| 2,755,091 | 7/1956 | Hara | 273/190 R |
| 3,104,880 | 9/1963 | Profera | 273/190 R |
| 3,246,898 | 4/1966 | Shoaf | 273/191 R X |
| 3,325,169 | 6/1967 | MacKniesh | 273/190 R |
| 3,415,523 | 12/1968 | Boldt | 273/190 R |
| 3,712,625 | 1/1973 | Taylor | 273/190 R |
| 3,770,280 | 11/1973 | Straus | 273/190 R |
| 4,302,014 | 11/1981 | Shull | 273/190 R |

*Primary Examiner*—George J. Marlo

[57] ABSTRACT

Apparatus is disclosed for fixedly positioning an axis of the body relative to the ground while permitting rotational motion of the head about the fixed axis, including a telescoping pole for anchoring in the ground, a crossbar extending between the telescoping pole and the axis of the body to be fixed, an adjustable clutch for permitting proper angular positioning of the crossbar, a head cap and chin strap for rigidly securing about the head of the golfer, and a rotatable bearing for securing the head cap to the crossbar to limit motion in all directions except rotational motion about the fixed axis.

6 Claims, 5 Drawing Figures

GOLFER'S HEAD MOVEMENT RESTRAINING DEVICE

BACKGROUND OF THE INVENTION

The present invention relates to devices for improving skills in the game of golf, and more particularly to a device for developing an improved swing which may be learned in a manner which is repeatable and consistent, by constraining body motion in such a way so as to force the golfer to repeatedly swing a golf club in the correct manner for maximum results.

In the prior art, a great many devices have been developed for aiding and improving skills in the game of golf. In particular, it has long been recognized that one of the most limiting factors in developing a consistent skill level in golf has been the apparent inability of most people to control body movements during the golf swing. This inability has been expressed as an inability to "keep the head down", but this is now recognized as merely a statement of a symptom of a problem rather than a statement of the problem itself. The real problem in developing a proper golf swing lies in solving the problem of motion of the shoulders and arms during the course of the swing. Ideally, the shoulders must traverse a predictable and consistent arc during the swing, without deviation in any direction which causes the head of the golf club to vary its path and to thereby strike the ball at an unpredictable angle. Shoulder movement is to a large extent dictated by head position, and any unusual or sidewise movement of the head during a golf swing causes a perceptible change in position of the shoulders, which in turn causes a change in the orientation of the golf club as it approaches a ball. A very minor movement of the shoulders causes the golf club face to turn in or out, resulting in a hook or slice, depending upon the nature of the motion. Therefore, it is extremely desirable to control shoulder motion during practice swings, so as to enable the golfer to develop the habit of consistent motion.

Many prior art devices have sought to improve these golfing skills by alerting the golfer to conditions which exist when inconsistent body motions are present. For example, U.S. Pat. No. 4,302,014 discloses an apparatus for fitting over a golfer's head, and which slips off a golfer's head in the event head movement occurs during the swinging of the golf club. U.S. Pat. No. 1,962,256 discloses a device for forcing the golfer to undertake a proper swing. In addition, the patent requires a complex shoulder harness for aiding in the development of a golf swing. U.S. Pat. No. 3,770,280, issued Nov. 6, 1973, discloses a headband attached to an electromagnetic device which becomes disconnected from its magnetic attachment whenever the golfer moves his head beyond a certain point. This serves as a reminder to the golfer that he has had excessive head movement.

There is a need for an apparatus for teaching the proper swing for addressing the ball in the game of golf, and a real need exists for a device of the type described wherein the body is constrained to follow a prescribed motion, and wherein the preferred motion may be practiced a great many times while under such constraint to thereby develop the proper swing as a matter of habit.

Accordingly, the present invention secures about the golfer's head and permits the golfer to pivot the head and shoulders in a natural movement associated with the correct swing of a golf club, while at the same time constraining the head and shoulders from erratic side motions which disturb the correct golf swing. Erratic lateral and vertical movement of the golfer's shoulders during the swing of the club are the primary cause of unpredictable shots in the game of golf.

SUMMARY OF THE INVENTION

The present invention comprises a hollow tube having a pointed end and which may be driven into the ground, and a telescopic vertical pole which snugly fits inside of the hollow tube, the pole having a frictional end surface so as to resist rotational motion about the axis of the pole, but to permit such motion whenever the frictional resistance is overcome. The invention further comprises an adjustable attachment to the top of the telescoping pole assembly, having a shaft extending therefrom, the shaft having a rotational coupling at its distal end, the coupling permitting relatively free rotational motion about an axis perpendicular to the shaft. A head cap is pivotally connected to the rotational coupling, and is shaped to tightly fit about the head of a golfer, the head cap also having a chin strap capable of tightening the head cap about the head.

It is a principal object of the present invention to provide an assembly for attachment to the head of a golfer, which holds the trunk axis of the body in a fixed position at an angle normal to the shaft hereinbefore described, wherein a golfer may be constrained while addressing and swinging at the ball.

It is a further object of the present invention to provide a golf training apparatus which is adjustable to accommodate different physical characteristics of golfers.

It is yet another object of the present invention to provide a golf training device having attached thereto a freely pivotal head cap, which head cap may be secured to the head of a golfer to constrain sidewise head motion during a golf swing.

BRIEF DESCRIPTION OF THE DRAWINGS

The foregoing and other objects and advantages of the invention will become apparent from the following specification and claims, and with reference to the appended drawings, in which:

DESCRIPTION OF THE PREFERRED EMBODIMENT

Figure 1:
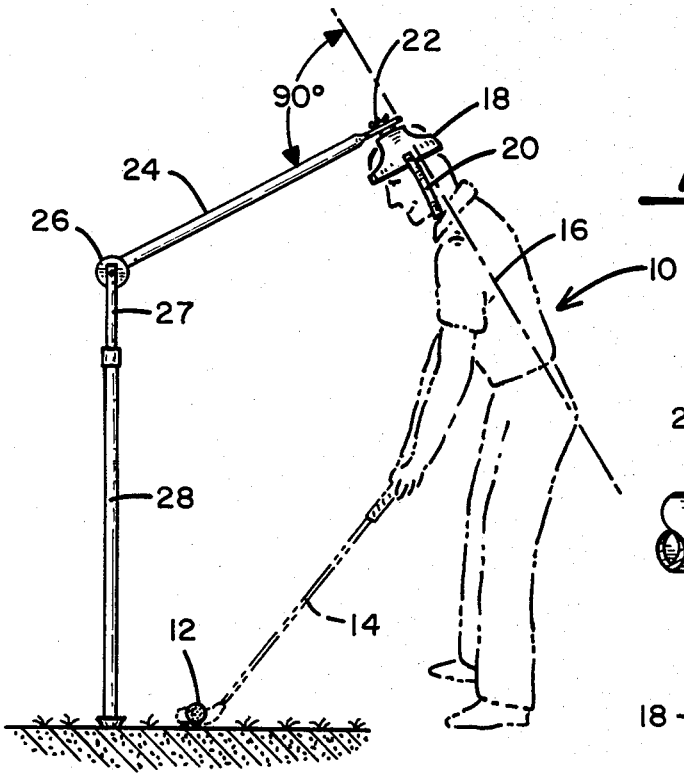
FIG. 1 shows the invention in a typical application.

Referring first to FIG. 1, there is shown a golfer 10 in a typical position addressing a golf ball 12. The golfer adopts a preferred stance, and positions himself at a comfortable distance from the golf ball wherein golf club 14 is aligned behind golf ball 12. In this preferred position, the axis 16 of the upper trunk of the body is inclined forwardly at an angle which is comfortable for the golfer. A vertical pole 28 is embedded into the ground at a slight distance from the golf ball, and a telescoping pole section 27 is adjustably arranged to a height which will be hereinafter described. A shaft 24 is attached to pole extension 27 by means of a clutch 26, clutch 26 permitting pivotal positioning of shaft 24 about the end of pole extension 26, but having means for fixedly positioning shaft 24 once a preferred position has been established. The distal end of shaft 24 has an attachment 22, which secures head cap 18 to shaft 24. Helmet 18 has a chin strap 20 for securing about the golfer's head, to ensure that the head is held in a relatively fixed position with respect to the apparatus. In the preferred embodiment, the height of pole extension 27, as well as the adjustment of clutch 26 is arranged so as to provide a right angle between body axis 16 and the axis of shaft 24.

Figure 2:
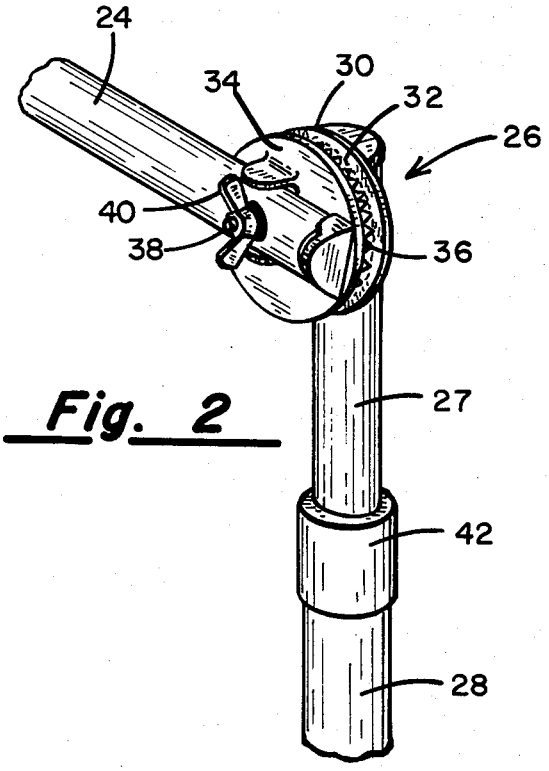
FIG. 2 shows the clutch mechanism.

FIG. 2 shows an expanded view of the clutch 26 portion of the invention. Pole extension 27 is fixedly attached to a clutch plate 30. Clutch plate 30 has a plurality of notched teeth 32 extending about its inner face in a circular arrangement. A second clutch plate 34, having similar notched teeth 36, is placed in engaging arrangement against clutch plate 30. Shaft 24 is affixed to clutch plate 34, by means of a bolt 38 which passes through clutch plate 30, clutch plate 34 and shaft 24. A wing nut 40 may be tightened to secure the enture assembly together.

Shaft 24 and clutch plate 34 may be pivotally rotated relative to clutch plate 30 upon loosening of wing nut 40 so as to permit disengagement of the respective teeth 36 and 32. Upon tightening of wing nut 40, teeth 32 and 36 become engaged and provide a fixed and locked connection between shaft 24 and pole extension 27. Pole extension 27 may be extended or retracted within pole 28 by means of a threaded coupler 42. The coupler 42 is a frictional coupler of the type well-known in the art, which secures pole extension 27 in any of a preferred number of extensible positions relative to shaft 28.

Figure 3:
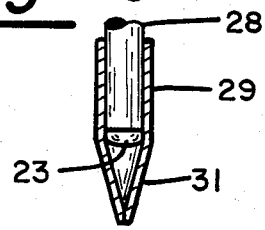
FIG. 3 shows a rear view of the head cap connection.
Figure 3:
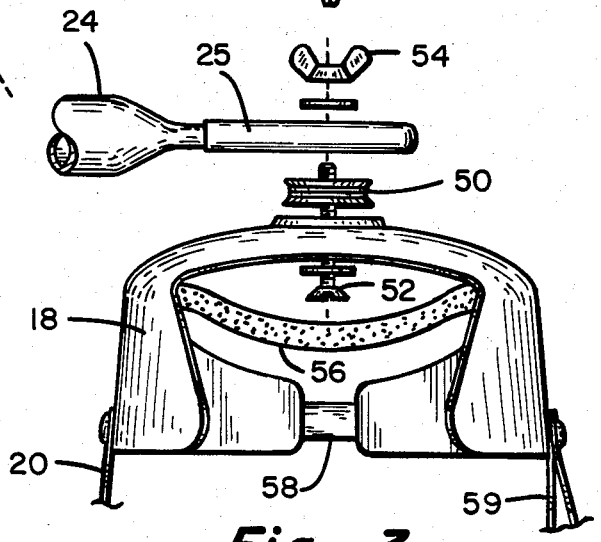

FIG. 3 shows a rear view of head cap 18 attached to the distal end of shaft 24. Shaft 24 has a flattened end 25, thereby forming two flattened faces through which a hole may be drilled. A bolt 52 is coupled through head cap 18, through a bearing assembly 50, and through shaft end 25, for connection to a wing nut 54 at the top surface of end 25. Bearing assembly 50 comprises a pair of plates having relatively free rotational movement therebetween, and may include a pair of circular plates having a plurality of steel balls riding between the plates for freedom of motion. Alternatively, bearing assembly 50 may be formed of bushings, wherein the bushings have relatively free rotational motion with respect to one another.

Figure 4:
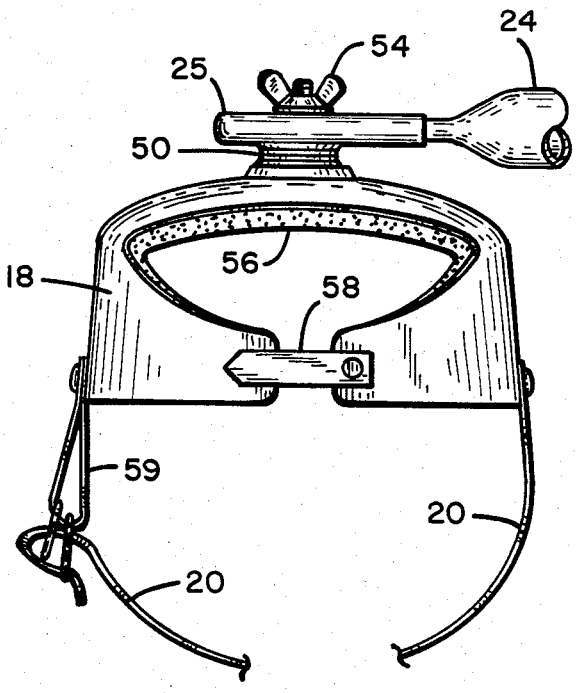
FIG. 4 shows a front view of the head cap.

FIG. 4 shows a front view of head cap 18, which has an interior resilient foam liner 56 for comfortable attachment to the head of the wearer. Helmet 18 also has a fastener 58, which preferably may be made from "Velcro" or other similar materials for providing a snug-fitting attachment to the head of the wearer. A chin strap 20 is attached to head cap 18, and may be coupled to attachment 59 for securing chin strap 20 about the head of the wearer.

Figure 5:
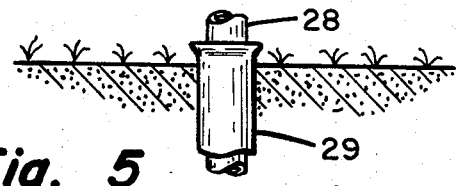
FIG. 5 shows a portion of the invention embedded into the ground.

FIG. 5 shows the attachment of the invention into a ground surface. A hollow tube 29 is formed with a pointed lower end 31. Tube 29 is sized so as to provide a snug fit of pole 28. Pole 28 has a lower end projection 23 which is preferably formed of resilient rubber or other similar material. End 23 becomes seated against the pointed end 31 of tube 29 so as to provide frictional resistance against rotational motion of pole 28 relative to tube 29.

In operation, tube 29 is driven into the ground and pole 28 is inserted therein. The golfer approaches the position of pole 28, and adopts a comfortable swinging stance wherein the head of the golf club is approximately 6–12 inches from the base of pole 28. Pole extension 27 is then telescoped into adjustment to a proper height, and clutch 26 is loosened so as to provide an axis of alignment of shaft 24 relative to the axis 16 of the body upper trunk of approximately 90°. The bolt passing through clutch 26 is then tightened to secure shaft 24 in this position, and head cap 18 is securely adjusted about the head of the golfer. Chin strap 20 is fastened, and the golfer is in position for practicing his golf swing.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A golf training device for affixing an axis of the body of a golfer relative to a preferred axis for constraining body motion to aid in the development of a consistent swing, comprising (a) a tubular pole having a first section adapted for insertion into the ground and having a second telescopic section extensibly fitted to said first section, said second section having a free end adapted for vertical projection (b) an adjustable toothed clutch attached to said second section free end, said clutch having a selectively rotatable member forming a part thereof;

(c) a shaft having an end attached to said selectively rotatable member and having a second free end;

(d) a rotatable coupling attached to said shaft second free end, said coupling permitting only rotational movement about a preferred axis normal to said shaft and parallel to the axis of the body of a golfer to be affixed relative to the preferred axis; and (e) a head cap attached to said rotatable coupling, said head cap having downwardly depending sides for tightly enclosing at least a portion of the head of a golfer and being adapted for tightly fitting over the head of a golfer, and said head cap having an adjustable chin strap adapted for securing about said head; whereby the head of a golfer is constrained to permit motion only about said preferred axis.

2. The apparatus of claim 1, wherein said clutch further comprises two facing toothed members, one of said members forming said selectively rotatable member.

3. The apparatus of claim 2, wherein said shaft free end is flattened.

4. The apparatus of claim 3, wherein said rotatable coupling further comprises a first bearing plate secured against said flattened shaft, and a second bearing plate secured against said head cap.

5. The apparatus of claim 4, further comprising a hollow tubular member sized slightly larger than said tubular pole first section and having a pointed and closed end.

6. The apparatus of claim 5, wherein said tubular pole first section further comprises a frictional fitting attached to the end of said pole adapted for insertion into said hollow tubular member.

* * * * *